United States Patent [19]

Schumacher

[11] Patent Number: 4,752,015

[45] Date of Patent: Jun. 21, 1988

[54] ATTACHMENT FOR TUBES

[75] Inventor: Clemens Schumacher, Sundern, Fed. Rep. of Germany

[73] Assignee: Robert Finke Kommanditgesellschaft, Fed. Rep. of Germany

[21] Appl. No.: 43,142

[22] Filed: Apr. 27, 1987

[30] Foreign Application Priority Data

Apr. 26, 1986 [DE] Fed. Rep. of Germany ... 8611552[U]

[51] Int. Cl.[4] ..... B65D 51/32

[52] U.S. Cl. ..... 215/228; 401/269

[58] Field of Search ..... 215/228; 401/269, 202

[56] References Cited

U.S. PATENT DOCUMENTS

| | | | |
|---|---|---|---|
| 514,290 | 2/1894 | Symonds | 401/269 |
| 847,252 | 3/1907 | Hoffman | 401/202 |
| 1,685,727 | 9/1928 | Stewart | 215/228 |

FOREIGN PATENT DOCUMENTS

| | | | |
|---|---|---|---|
| 73189 | 4/1960 | France | 401/202 |
| 895257 | 5/1962 | United Kingdom | 401/269 |
| 928144 | 6/1963 | United Kingdom | 401/202 |

*Primary Examiner*—Donald F. Norton
*Attorney, Agent, or Firm*—Collard, Roe & Galgano

[57] ABSTRACT

There is provided an attachment having a pot-shaped bottom element and a sealing cap adapted to be arranged on the neck of tubes, bottles or the like. The top side of the ceiling of the bottom element, which is supported by the side wall of the pot-shaped bottom element, is fitted with brush-like bristles which are covered by the sealing cap. The central region of the bottom element ceiling is provided with an orifice into which projects a tongue extending from the bottom side of the sealing cap, the free end of the tongue entering the orifice in the ceiling of the bottom part and sealing the same in the manner of a plug. The sealing cap has in the bottom edge region a female thread which cooperates with a male thread on the neck of the tube so that the side wall of the bottom element and the female thread of the sealing cap oppose one another in the same cross-sectional plane thus resulting in a space-saving association of the bottom element having the brush-like bristles, such association being close to the neck.

9 Claims, 3 Drawing Sheets

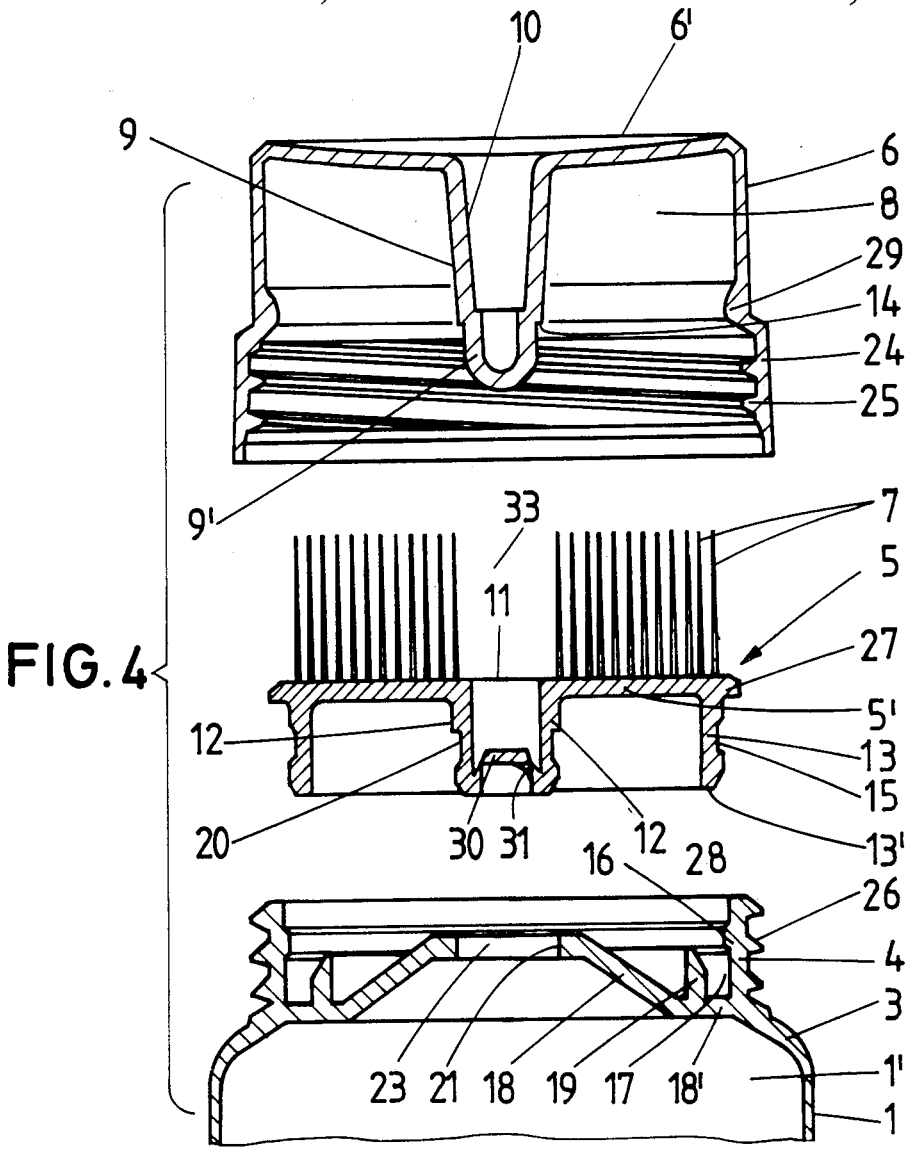
FIG. 4
FIG. 5
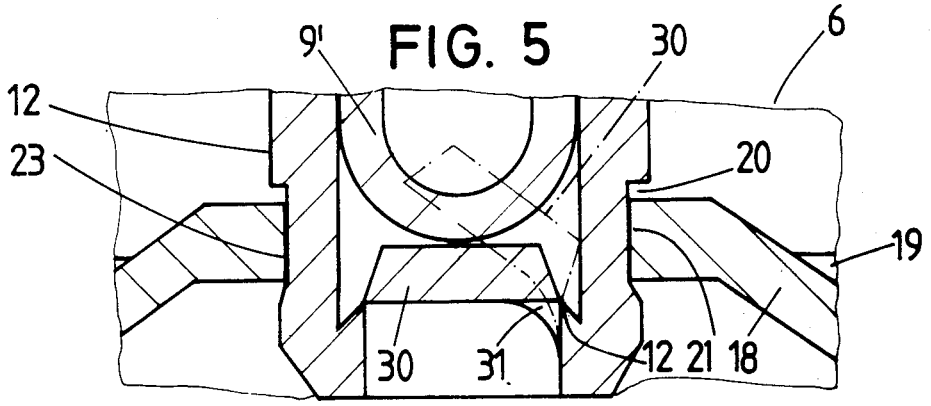

ATTACHMENT FOR TUBES

The present invention relates to an attachment designed to be arranged on the neck of tubes, bottles or the like.

An attachment of the type described herein is disclosed in German utility-model patent DE-GM No. 82 31 682, where the region of association of the bottom element of the attachment supporting the brush-like bristles extends with a relatively wide spacing above the region where the sealing cap and the tube neck are threadably joined with one another. The construction according to this German patent requires a rather long neck and a correspondingly long sealing cap, which results in the usage of a considerable amount of material since such packaged applicators are mass-produced articles.

The object of the present invention is to provide an attachment of the type described above for tubes, bottles or the like in which the bottom element forming the bristle body can be arranged as closely as possible to the region of neck attachment, in a compact, space-saving embodiment of such packaged applicators.

The above object is accomplished in accordance with the present invention by the provision of an attachment which includes a bottom element and a sealing cap. The bottom element is pot-shaped having a ceiling part supported by a side wall thereof. The ceiling part has a centrally disposed orifice therein and brush-like bristles extending from the upper surface. The sealing cap covers the brush-like bristles and has a tongue which extends from the bottom side thereof and with its free end enters into and seals the orifice in the ceiling part of the bottom element. The sealing cap is provided with tube engaging means in the form of female screw threads at the lower edge thereof which are adapted to cooperate with cap engaging screws on the tube in the form of male screw threads. The side wall of the bottom element and the tube engaging means of the sealing cap are disposed opposite one another in the same plane.

By virtue of such an embodiment, an extremely compact attachment is achieved for tubes, and the like. The minimum axial length required for a secure association of the bottom element is usefully exploited for accommodating the female thread of the sealing cap. This leads to a very space-saving type of construction and the axial length gained thereby can be exploited in terms of volume, that is to say, a greater amount of filling content can be offered with the same starting length of corresponding packages. Furthermore, the sealing cap is more handy in that it can be gripped better than a long, beaker-type structure, ergonometrically speaking. Solid seating of the parts to be joined is achieved by simple means in that the shell of the side wall of the bottom element has a groove or undercut for snap-locking therein the inner edge of the neck of the tube or the like. The matching snap bead is molded on the neck. Even high mechanical forces acting on the bottom element cannot impair such anchoring. A safe sealing effect as well as advantageous clamping of the bottom element with cooperation of the sealing cap is accomplished in that the inner wall of the sealing cap has a sealing bead which is supported on the edge zone of the ceiling of the bottom element, this edge zone overlapping the face edge of the neck. Furthermore, it is advantageous that a collar extends from the orifice in the bottom element to about the bottom edge of the side wall of the bottom element. In addition to forming a strand of the squeezed out contents, such collar has a stabilizing function, so that the ceiling of the bottom element may be quite thin. Moreover, a collar of such length may be advantageously exploited for sealing, for which purpose an offset end segment of the tongue enters the collar. Advantageously, the tongue is designed hollow for drawing in the top side of the sealing cap. Such a hollow tongue is more flexible and found to be more readily adaptable to different orifices, such differences being caused by tolerance variations. Furthermore, it is proposed that a valve head be molded in the collar forming an insurmountable barrier for the medium to be dispensed. When the orifice opening is in a downwardly directed position, the contents cannot leak out in an uncontrolled manner, but rather intentional displacement by applying pressure to the wall of the tube or the like is required. This means that the brushing activity can be carried out without necessarily causing the contents to be dispensed. Furthermore, the tongue has an additional function in that its free end biases the valve head in its closed position. Finally, the invention proposes that the jacket wall of the collar is provided with an engaging groove for engaging with the inner edge of a transverse wall of the neck of the tube or the like. In this way, the bottom element is additionally anchored at its center. This anchoring is disposed in the same cross-sectional plane as the edge of the bottom element and the female thread thereof. Finally, it is advantageous that the bottom region of the side wall of the bottom element or edge thereof enters an annular groove formed in the neck of the tube. Such an embodiment serves the purpose of securing the snap joint between the shell of the side wall of the bottom element and the corresponding surface of the neck which is disposed slightly above the level on which the edge of the bottom element enters the annular groove.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 4 is a cross-sectional view of the portion of the tube shown in FIG. 2 with the parts thereof exploded; and FIG. 5 is an enlarged cross-sectional view of the valve head region in the collar of the bottom element of the attachment.

Figure 1:
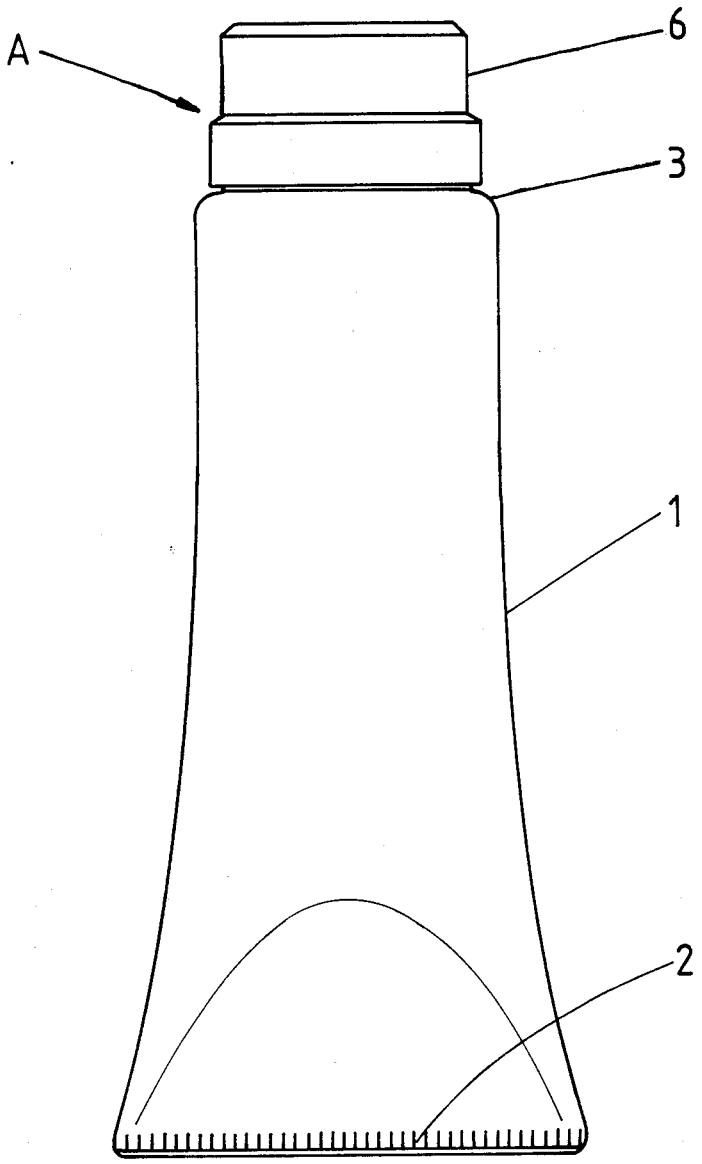
FIG. 1 is an elevational view of a tube according to the present invention.
Figure 2:
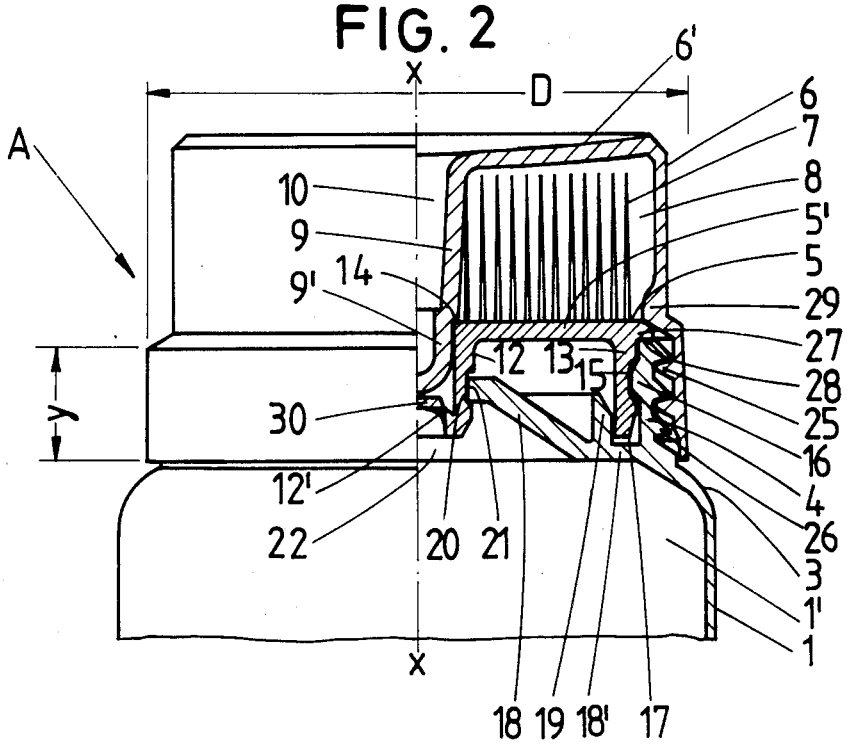
FIG. 2 is an enlarged partial cross-sectional view of a portion of the tube of FIG. 1 in the region of the sealing cap.
Figure 3:
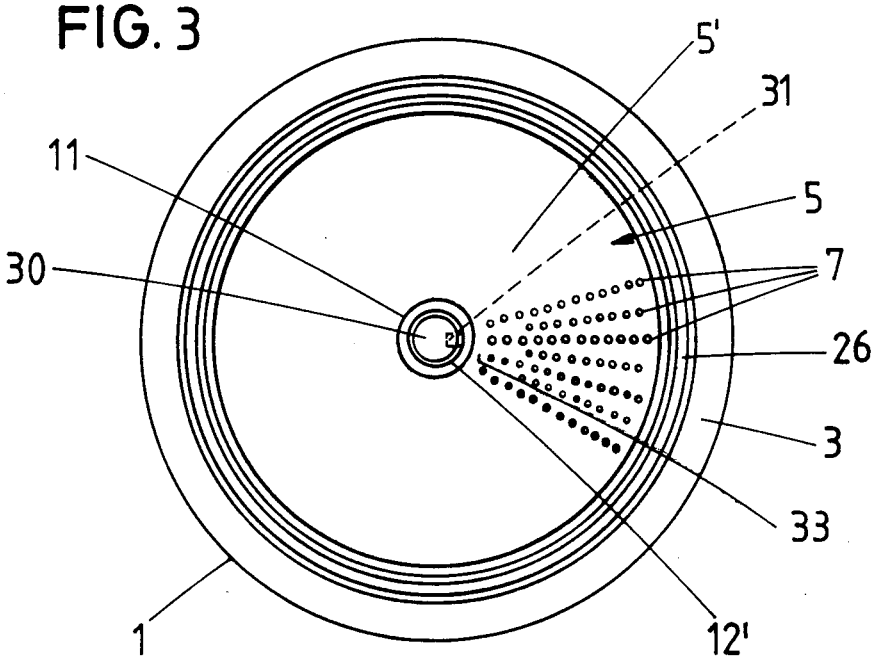
FIG. 3 is a top plan view of the tube of FIG. 2 with the sealing cap removed showing a portion of the brush-like bristles.

Now turning to the drawings, there is shown in FIG. 1 a tube 1 containing, for example a textile cleaning agent, shoe-polish or some other agent for brush application, formed of plastic material and which can be squeezed for forcing out the medium. The bottom region is sealed, for example thermally or heat sealed with the weld denoted by reference numeral 2. FIG. 2 clearly shows that the other end of tube 1 is provided with a short neck 4 by means of a slightly drawn-in edge 3 forming a rounded shoulder. The shoulder projection is minor.

Neck 4 of tube 1 is covered by an attachment A designed to be associated with the former. The components of attachment A are a pot-shaped bottom element 5 designed to be associated with neck 4 by a snap connection or joint, and a sealing cap 6 covering bottom element 5 when the tube is closed. Such components, too, are made of plastic material selected for this purpose of application. For example, for the bottom element, plastic material is selected that is optimally suitable for forming upright, brush-like bristles 7 molded to match the bottom element. Sealing cap 6 forms a protective space 8 covering bristles 7.

Bristles 7 extending from ceiling 5' of the pot-like bottom element 5 have a break or recess 33 in the center region. A tongue 9 projecting from the bottom side of sealing cap 6 extends into this center region. Tongue 9 is hollow and realized or embodied as a drawn-in element 10 starting from top side 6' of sealing cap 6.

The free end 9' of tongue 9, which starts with a cylindrical shape but ends in a dome-shape, enters an orifice opening 11 in ceiling 5' of bottom element 5, sealing the opening in the manner of a plug.

Orifice 11 is formed within the region of collar 12 which extends in the same direction as drawn-in element 10, which is directed towards the tube, and has its free end disposed substantially in the same plane as the face edge 13' of the basically cylindrical side wall 13 of bottom element 5. End 9' of tongue 9 entering cylindrical orifice 11 formed by collar 12 is offset as compared to the drawn-in element 10, which is slightly funnel-shaped on the tube side. Reference numeral 14 denotes the shoulder, which seats on the top edge of orifice 11, sealing the latter when sealing cap 6 closes the tube.

For securing bottom element 5 on neck 4 of tube 1 by a snap-like lock or for clipping it on such neck, the shell of side wall 13 of element 5 has a throat or annular undercut 15 disposed centrally thereon. Throat 15 extends all around the shell for receiving with a snap fit projection 16 on the corresponding inside surface of neck 4. Projection 16 is realized as an annular bead having its top and bottom flanks chamfered or bevelled which, together with a chamfer on the lower outer edge of side wall 13, facilitates the association of bottom element 5 with tube 1.

FIG. 2 shows that the lower region of the edge of bottom element 5 is received in an annular groove 17 formed in neck 4. Outwardly, annular groove 17 is delimited by the lower segment of neck 4, which has its root in edge 3 of tube 1. At the bottom the groove is delimited by a segment 18' of a transverse wall 18, the latter delimiting tube 1 on the attachment side. Inwardly, the groove is delimited by an annular wall 19 which extends parallel with neck 4, starting from the segment 18' of transverse wall 18. The top edge of wall 19 is chamfered on the side of the annular groove, so that the edge of the bottom element is guided into such groove, where it is supported, furthermore, by annular wall 19 under the locking load of the clip connection.

Transverse wall 18 extends substantially horizontally only within the proximity of the annular groove 17, i.e., perpendicular to the longitudinal center axis x—x of the tube, because on the inner side of annular wall 19 it rises funnel-like in the direction of the sealing cap 6 to about half the height of collar 12. The outer wall of collar 12 is formed with an engagement groove 20, into which snaps the inner edge 21 of transverse wall 18, which is centrally open, so that a point of connection is present not only within the peripheral region of bottom element 5 but also in the center region of the latter, such joint being between bottom element 5 and neck 4 of tube 1. The bottom outer edge of central collar 12 is chamfered so that the latter, which acts in the manner of a hollow arresting lug, can be readily inserted. The conical or tapered shape of the bottom edge of collar 12 is clearly shown in FIGS. 2, 4 and 5. The cavity 22, which is created by drawing in the transverse wall 18 on the side of the sealing cap, accommodates the overlapping segment of the collar 12, so that the latter does not project into the interior space 1' of tube 1, which in turn means that squeezing or folding of the tube body is not obstructed and the contents of the tube can be discharged practically without any residue remaining in the tube.

On the inner side of the receptacle, the flank of engaging groove 20 is bevelled, whereas the flank on the outer side of the receptacle is steep, extending perpendicular to the longitudinal central axis x—x and with a small spacing above the annular region of transverse wall 18, which region is folded again into the horizontal line. The break in wall 18 for collar 12 is denoted by reference numeral 23.

Sealing cap 6 is threadably engaged with tube 1. The lower edge region of sealing cap wall 24 is provided on the inside surface with female thread 25. Matching male thread 26 is disposed on the shell of neck 4 of tube 1. This association is such that side wall 13 of the bottom element and female thread 25 of sealing cap 6 oppose one another in the same cross-sectional plane. In this way, central locking or arresting and peripheral arresting both are accommodated on a relatively short axial segment y, which is slightly shorter than the length of brush-like bristles 7 or, for example, comes to about one fifth of the diameter D of attachment A.

Ceiling 5' of bottom element 5 projects laterally beyond the shell surface of side wall 13 in such a way that an annular ceiling support edge 27 overlaps the face edge 28 of neck 4. This supporting overlap position is secured by sealing bead 29 disposed on the inside wall of sealing cap 6 and supported on top of the support edge 27. In the inside, this sealing bead is flush with the inside surface of the neck in that it is in the same plane. The bottom side of sealing bead 29 is bevelled and support edge 27 has a matching bevelling. Tightening of the thread causes the supporting edge 27 to engage with a clamping effect between sealing bead 29 and neck 4, which effectively counteracts the discharge of medium still present within the region of the bristles via the thread.

In order to achieve controlled dispensing of the filling contents from the tube when the latter is used, collar 12 has an interior valve head 30 molded in the form of a valve flap in the upper section of the collar, which section has a larger cross section, which means that such valve flap extends from the undercut shoulder edge 12' of this collar. A material molding disposed on the tube side serves as the hinging point, such molding being a narrow gusset 31 extending from the bottom side of valve head 30 and having its root in the sectionally reduced zone of the interior wall of collar 12. The embodiment of valve head 30 in the form of a truncated cone, which is clearly shown by FIG. 5, produces an even greater opening angle than obtained in a favorable manner through the gradation or stepping within the proximity of the shoulder edge. As soon as the tube is squeezed, the metered content is forced through the collar serving as a guiding duct and via orifice 11 into the region of the center bristle recess 33, where it is distributed by the motion of the bristles and transferred to the surface onto which it is being applied by brushing.

In the closing position of sealing cap 6, the free end 9' of tongue 9 comes to rest against the back of valve head 30 which, in this way, supports the lip-like annular zone within the region of edge 12' of the collar.

While only a single embodiment of the present invention has been shown and described, it will be obvious that many changes and modifications may be made thereunto without departing from the spirit and scope of the invention.

What is claimed is:

1. An attachment adapted to be arranged on the neck of a tube, bottle and the like, comprising:

a pot-shaped bottom element having a ceiling part supported by a side wall of the bottom element, said ceiling part having a centrally disposed orfice therein and bursh-like bristles extending from the top surface thereof, a collar extends downwardly from said orifice approximately to the bottom edge of the side wall wherein a valve head is formed integrally therewith; and a sealing cap covering said brush-like bristles having a tongue extending from the bottom side thereof, the free end of said tongue entering into and sealing the orifice in the ceiling part of said bottom element, said sealing cap having tube engaging means at the lower edge thereof adapted to cooperate with cap engaging means of a tube, the side wall of said bottom element and the tube engaging means of said sealing cap being disposed opposite one another in the same plane.

2. The attachment according to claim 1, wherein the tube engaging means of said sealing cap are female screw threads adapted to engage male screw threads on a tube.

3. The attachment according to claim 1, wherein the outer surface of the side wall of said bottom element includes an undercut adapted to engage in a snap-like manner with a projection in the neck of a tube.

4. The attachment according to claim 1, wherein the inside wall of the sealing cap has a sealing bead extending inwardly and supported on an outer edge zone of the ceiling part of the bottom element, said outer edge zone overlapping a face edge of a tube neck.

5. The attachment according to claim 1, wherein the tongue extending from the bottom side of said sealing cap includes an end segment having an offset of reduced diameter than the remainder of said tongue which is adapted to enter the collar extending from the orifice of the ceiling part of the bottom element.

6. The attachment according to claim 1, wherein the tongue extending from the bottom side of the sealing cap is hollow and is formed by a drawn-in manufacturing operation of the top side of the sealing cap.

7. The attachment according to claim 1, wherein the free end of the tongue extending from the sealing cap is adapted to bias said valve head in the closed position when said bottom element and sealing cap are arranged on the neck of a tube.

8. The attachment according to claim 1, wherein the outer wall of the collar extending downwardly from the orifice in the ceiling wall of the bottom element includes a peripheral engaging groove which is adapted to engage with an inner edge of a transverse wall of a tube extending from the neck thereof.

9. The attachment according to claim 1, wherein the lower extremity of the side wall of the bottom element is adapted to be received in an annular groove formed in the neck of the tube.

* * * * *